US006008157A

United States Patent [19]

Takeuchi et al.

[11] Patent Number: 6,008,157

[45] Date of Patent: Dec. 28, 1999

[54] THERMAL TRANSFER SHEET

[75] Inventors: Haruo Takeuchi; Junichi Hiroi; Takeshi Ueno; Nobuyuki Harada, all of Tokyo-To, Japan

[73] Assignee: Dai Nippon Printing Co., Ltd., Japan

[21] Appl. No.: 08/946,573

[22] Filed: Oct. 8, 1997

Related U.S. Application Data

[62] Division of application No. 08/535,321, Sep. 27, 1995, Pat. No. 5,714,434.

[30] Foreign Application Priority Data

Sep. 28, 1994 [JP] Japan ..... 6-258720
Sep. 28, 1994 [JP] Japan ..... 6-258721

[51] Int. Cl.[6] ..... B41M 5/035; B41M 5/38

[52] U.S. Cl. ..... 503/227; 428/195; 428/207; 428/323; 428/330; 428/331; 428/913; 428/914

[58] Field of Search ..... 428/195, 207, 428/484, 488.1, 488.4, 323, 331, 330; 503/227

[56] References Cited

U.S. PATENT DOCUMENTS 5,714,434 2/1998 Takeuchi et al. ..... 503/227

*Primary Examiner*—Bruce H. Hess
*Attorney, Agent, or Firm*—Parkhurst & Wendel, L.L.P.

[57] ABSTRACT

A thermal transfer sheet including: a substrate, a thermal transfer layer provided on one side of the substrate, and a heat-resistant slip layer, containing particles, provided on the other side of the substrate, the shot-type abrasion loss of the particles contained in the heat-resistant slip layer being 15 to 100 mg. A thermal transfer sheet including: a substrate, a heat-transferable colorant layer provided on one side of the substrate; and a heat-resistant slip layer, containing an inorganic filler, provided on the other side of the substrate, the inorganic filler comprising a main component and an impurity, the hardness of the main component and the hardness of the impurity having the relationship: main component<impurity, the ratio of the highest diffraction line intensity Y of the impurity to the highest diffraction line intensity X of the main component in the X-ray diffraction of the inorganic filler being $0.03 \leqq Y/X \leqq 0.20$.

5 Claims, No Drawings

THERMAL TRANSFER SHEET

This is a Division of application Ser. No. 08/535,321 Sep. 27, 1995 now U.S. Pat. No. 5,714,434.

BACKGROUND OF THE INVENTION

The present invention relates to a thermal transfer sheet for use in a thermal recording system and more particularly to a thermal transfer sheet which avoids abrasion of a thermal head, collection of sheet debris on a thermal head, and sticking.

A dye sublimation thermal transfer sheet comprising a substrate film bearing, on one side thereof, a dye layer containing a heat-transferable dye and a hot-melt thermal transfer sheet having a hot-melt ink layer containing a wax which can be melt-transferred upon heating have hitherto been used as thermal transfer sheets for use in thermal printers, facsimiles and the like.

For the above conventional thermal transfer sheets, paper, such as an about 10 to 20 μm-thick capacitor paper or paraffin paper, or a plastic film, such as an about 3 to 10 μm-thick polyester or cellophane, is used as a substrate film, a dye layer formed of a dispersion or a solution of a dye in a binder resin or a hot-melt ink layer using a wax with a black pigment, such as carbon black, milled thereinto is provided on the substrate film, and, if necessary, a heat-resistant slip layer is provided on the back side of the substrate film for improving the slip property.

Predetermined sites of the thermal transfer sheet are heated and pressed according to image information from the back side of the substrate film by means of a thermal head or the like to transfer a dye in a site corresponding to a print portion of the dye layer onto an image-receiving sheet, thereby conducting printing.

In the case of the conventional thermal transfer sheet, however, in the course of printing of several thousand sheets, the coating of the heat-resistant slip layer or a filler contained in the coating is scraped off by the thermal head. Further, the coating of the heat-resistant slip layer is, in some cases, heat-fused to the thermal head to cause the collection of sheet debris on the head or the abrasion of a protective film of the thermal head. These unfavorable phenomena often lead to troubles such as uneven density.

In order to prevent the abrasion of a thermal head, EP-A 577051 proposes the use of soft particles, for example, particles having a Mohs hardness of not more than 3. When particles of natural minerals are used, however, the hardness often varies depending upon the kind and content of impurities even though the natural minerals are identical to each other with respect to the main component. Specifically, even though the main component has a Mohs hardness of not more than 3, the presence of a crystal having a Mohs hardness of not less than 3 as an impurity makes it impossible for particles of such a natural mineral to prevent the abrasion of a thermal head, suggesting that mere attention to the Mohs hardness alone never provides a solution to the problem of abrasion of the thermal head.

Further, when such soft particles are used, the particles are collapsed by heat or pressure applied during printing, causing the heat-resistant slip layer to be heat-fused to the thermal head. This often results in the collection of sheet debris on the thermal head or sticking.

If particles contained in the heat-resistant slip layer are protruded from the surface of the heat-resistant slip layer, the particles can scrape off the sheet debris, if any, to prevent the collection of the sheet debris on the thermal head. As described above, however, when soft particles which are less likely to abrade the thermal head are used, the particles are collapsed by heat or pressure applied during printing, making it impossible to scrape off the sheet debris on the head.

DISCLOSURE OF THE INVENTION

First Invention

The present inventors have made extensive and intensive studies with a view to solving the above problems and, as a result, have found that the abrasion of a thermal head, the collection of sheet debris on a thermal head, and sticking can be prevented by using a thermal transfer sheet comprising: a substrate; a thermal transfer layer provided on one side of the substrate; and a heat-resistant slip layer, containing particles, provided on the other side of the substrate opposite to the thermal transfer layer, wherein the shot-type abrasion loss of the particles contained in the heat-resistant slip layer being 15 to 100 mg.

Further, it has been found that the use of a thermal transfer sheet using a mixture of two or more types of particles different from each other in shot-type abrasion loss can solve the above problems.

In the above thermal transfer sheet of the present invention, when the shot-type abrasion loss of particles contained in the heat-resistant slip layer is 15 to 100 mg, there is no fear of the particles being so soft that the particles are collapsed by heat or pressure applied during printing, resulting in collection of sheet debris on the thermal head. Further, in this abrasion loss range, even though the collection of sheet debris on the thermal head occurs, the particles have hardness high enough to scrape off the debris on the head, preventing the accumulation of the sheet debris on the head.

On the other hand, since the upper limit of the shot-type abrasion loss is specified as described above, the abrasion of the thermal head by the particles can be prevented, thus enabling a heat-resistant slip layer to be provided which can solve a problem of the collection of sheet debris on the thermal head, as well as a problem of abrasion of the thermal head.

Second Invention

The second invention relates to a thermal transfer sheet and more particularly to a thermal transfer sheet which has a heat-resistant slip layer formed of a specific material and, by virtue of the specific material, possesses improved properties in respect of resistance to cockle during printing and sticking to the thermal head and prevention of the thermal head from being abraded.

Thermal transfer sheets known in the art are a dye sublimation thermal transfer sheet comprising a plastic film, such as a polyester film, as a substrate film and a dye layer, formed of a sublimable dye and a binder, provided on one side of the substrate film and a hot-melt thermal transfer sheet having the same layer construction as the dye sublimation thermal transfer sheet, except that an ink layer formed of a colorant and a hot-melt composition is used instead of the dye layer. For these thermal transfer sheets, imagewise heating is carried out through the back side by means of a thermal head to transfer a dye contained in the dye layer or the ink layer onto an image-receiving object, thereby forming an image.

The above conventional thermal transfer sheets suffer from sticking of the substrate film to the thermal head during printing, breaking of the thermal transfer sheet due to lack of the slip property, and cockle during printing. Japanese Patent Laid-Open Nos. 171992/1983 and 187396/1983 describe that coating of a heat-resistant slip layer containing a lubricant or an inorganic or organic filler on the side of the substrate film remote from the dye layer or the ink layer is effective for preventing these unfavorable phenomena.

In the formation of an image by means of a thermal head using such a thermal transfer sheet, when energy corresponding to print density is applied to the thermal transfer sheet, stable slip property and releasability over whole energy range are required of the thermal transfer sheet.

However, lack of slip property and releasability or deviation of position of the thermal head from the contemplated position causes the pressing force of the thermal head to become excessive or to be uneven, resulting in fusing of the thermal head to the thermal transfer sheet. This leads to sticking, a failure of the thermal transfer sheet being carried, and, in extreme cases, breaking of the thermal transfer sheet.

In this case, it is known that the slip property can be stabilized by adding an inorganic or organic filler to the heat-resistant slip layer to roughen the surface of the heat-resistant slip layer, thereby reducing the area of contact of the heat-resistant slip layer with the thermal head. However, when the filler used has excessively high hardness, it unfavorably abrades the surface protective layer of the thermal head, shortening the service life, in terms of printing, of the thermal head. On the other hand, when it has excessively low hardness, the filler is collapsed if the pressing force of the thermal head is high, deteriorating the surface roughening effect. Further, in this case, the heat-resistant slip layer is scraped off by the thermal head, resulting in collection of sheet debris on the thermal head.

In order to solve the above problems, the filler used should be selected by taking the hardness into consideration. However, when inorganic fillers are used, they are, in many cases, natural minerals which are often different form one another in hardness depending upon the type and content of impurities even though the main component is the same.

Accordingly, an object of the second invention is to provide a thermal transfer sheet, having a good heat-resistant slip layer, which, by virtue of the optimization of the hardness of the inorganic filler used in the heat-resistant slip layer, possesses excellent slip property and releasability, provides good thermal head carriability, causes none of sticking, cockle, and breaking, and is less likely to abrade the thermal head.

The second invention provides a thermal transfer sheet comprising: a substrate; a heat-transferable colorant layer provided on one side of the substrate; and a heat-resistant slip layer, containing an inorganic filler, provided on the other side of the substrate, the inorganic filler comprising a main component and an impurity, the hardness of the main component and the hardness of the impurity having the relationship: main component<impurity, the ratio of the highest diffraction line intensity Y of the impurity to the highest diffraction line intensity X of the main component in the X-ray diffraction of the inorganic filler being $0.03 \leqq Y/X \leqq 0.20$.

Thus, specifying the content of an impurity in an inorganic filler contained in a heat-resistant slip layer of a thermal transfer sheet according to the present invention eliminates a fear of abrasion of a surface protective film of a thermal head caused by excessively high hardness of the filler and a fear of collapse of a filler caused by pressing force of the thermal head due to excessively low hardness of the filler to cause the heat-resistant slip layer to be heat-fused to the thermal head, resulting in collection of sheet debris on the thermal head. This makes it possible to provide a thermal transfer sheet, having a good heat-resistant slip layer, which has excellent slip property and releasability, provides excellent thermal head carriability, causes none of sticking, cockle, and breakage, and is less likely to abrade the thermal head.

BEST MODE FOR CARRYING OUT THE INVENTION

The thermal transfer sheets of the first and second inventions, including materials used and methods for producing them, will now be described in detail.

First Invention

Preferred substrates used in the thermal transfer sheet of the first invention include films of polyesters such as polyethylene terephthalate, polyethylene naphthalate, and 1,4-polycyclohexylene dimethyl terephthalate; cellophane and cellulose derivatives such as cellulose acetate; resins such as polyethylene, polypropylene, polystyrene, polyphenylene sulfide, polycarbonate, polyvinyl chloride, polyvinylidene chloride, nylon, polyimide, polyvinyl alcohol, fluororesin, chlorinated rubber, and ionomers. Further, the substrate may be a composite of the above resin and a paper, such as a capacitor paper or a paraffin paper, or a non-woven fabric. Furthermore, if necessary, it is also preferred to provide an adhesive layer (a primer layer) on one side or both sides of the film.

The thickness of the substrate may be properly selected depending on applications and materials so that the mechanical strength and the heat conductivity is appropriate. It is generally about 1.5 to 50 $\mu$m, preferably about 2 to 10 $\mu$m.

The thermal transfer layer is not particularly limited, and any conventional thermal transfer layer may be used. For example, a thermal transfer layer for a dye sublimation thermal transfer sheet may be formed using a dispersion or a solution of a heat-transferable dye in a binder resin.

A preferred binder resin is such that it has a suitable affinity for the dye and, upon heating, the dye contained in the binder resin is sublimated (causes migration) and transferred onto a dye-receiving material. In this case, the binder resin, as such, should not be transferred upon heating.

Examples of resins usable as the binder resin include cellulosic resins such as ethyl cellulose, hydroxyethyl cellulose, ethylhydroxyethyl cellulose, hydroxypropyl cellulose, methyl cellulose, cellulose nitrate, cellulose acetate, and cellulose acetate butyrate; vinyl resins such as polyvinyl alcohol, polyvinyl acetate, polyvinyl butyral, polyacrylamide, and polyvinylpyrrolidone; polyester resins; and polyamide resins.

The content of the dye in the thermal transfer layer may vary depending upon the sublimation (melting) temperature, dying properties and the like of the dye. It, however, is preferably not less than 30 parts by weight, still preferably 30 to 300 parts by weight, based on 100 parts by weight of the binder resin. When the dye content is less than 30 parts by weight, the print density and the heat sensitivity are low, while when it exceeds 300 parts by weight, the storage stability and the adhesion of the thermal transfer layer to the substrate film are likely to be deteriorated.

The dye contained in the thermal transfer layer, upon heating, should be melted, diffused, or sublimated and transferred to a dye-receiving material. It is particularly preferably a disperse dye. The dye is selected by taking into consideration the sublimation (melting), hue, light fastness, solubility in a binder resin and the like.

Examples of the dye include diarylmethane dyes; triarylmethane dyes; thiazole dyes; methine dyes such as merocyanine; azomethine dyes, exemplified by indoaniline, acetophenone azomethine, pyrazolone azomethine, imidazole azomethine, imidazoazomethine, and pyridone azomethine; xanthene dyes; oxazine dyes; cyanomethylene dyes exemplified by dicyanostyrene and tricyanostyrene; thiazine dyes; azine dyes; acridine dyes; benzene azo dyes; azo dyes exemplified by pyridone azo, thiophene azo, isothiazole azo, pyrrole azo, pyrazole azo, imidazole azo, thiadiazole azo, triazole azo, and disazo dyes; spiropyran dyes; indolinospiropyran dyes; fluoran dyes; rhodamine lactam dyes; naphthoquinone dyes; anthraquinone dyes; and quinophthalone dyes. Specific examples of the dye used in the thermal transfer layer are as follows:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 26, 36, 56, and 31;

C.I. Solvent Yellow 56, 14, 16, and 29;

C.I. Solvent Blue 70, 35, 63, 36, 50, 49, 111, 105, 97, and 1;

C.I. Solvent Red 135, 81, 18, 25, 19, 23, 24, 143, 146, and 182;

C.I. Solvent Violet 13;

C.I. Solvent Black 3; and

C.I. Solvent Green 3.

For example, cyan dyes include Kayaset Blue 714 (Solvent Blue 63, manufactured by Nippon Kayaku Co., Ltd.), Foron Brilliant Blue S-R (Disperse Blue 354, manufactured by Sandoz K.K.), and Waxoline AP-FW (Solvent Blue 36, manufactured by ICI Japan); magenta dyes include MS-REDG (Disperse Red 60, manufactured by Mitsui Toatsu Chemicals, Inc.) and Macrolex Violet R (Disperse Violet 26, manufactured by Bayer); and yellow dyes include Foron Brilliant Yellow S-6GL (Disperse Yellow 231, manufactured by Sandoz K.K.) and Macrolex Yellow 6G (Disperse Yellow 201, manufactured by Bayer).

The thermal transfer layer may be provided on the substrate film by known methods.

For example, a dye and a binder resin are dissolved or dispersed in a solvent to prepare an ink composition, for a thermal transfer layer, which is then applied onto a substrate film by an appropriate method selected from known printing or coating methods. If necessary, any additive may be added to the ink composition for a thermal transfer layer. For example, in order to regulate the coatability of the ink composition and to prevent the thermal transfer layer from being fused to an image-receiving sheet, organic fine particles, such as polyethylene wax particles, and inorganic fine particles may be incorporated into the dye layer. The thickness of the dye layer is suitably 0.2 to 5.0 $\mu$m, preferably about 0.4 to 2.0 $\mu$m.

The present invention is characterized in that a heat-resistant slip layer containing particles is provided on the side of the substrate remote from the thermal transfer layer.

The material for the heat-resistant slip layer may be the same as that for the conventional slip layer. However, it is not particularly limited, and other materials may also be used.

The binder resin used in the present invention may be any known resin, and examples thereof include polyester resins; polyacrylic resins; polyvinyl acetate resins; styrene acrylate resins; polyurethane resins; polyolefin resins; polystyrene resins; polyethylene resins; polypropylene resins, polyacrylate resins; polyacrylamide resins; polyvinyl chloride resins; polyvinyl acetal resins such as polyvinyl butyral resins and polyvinyl acetoacetal; cellulosic resins such as ethyl cellulose, hydroxyethyl cellulose, ethylhydroxyethyl cellulose, hydroxypropyl cellulose, methyl cellulose, cellulose nitrate, cellulose acetate, and cellulose acetate butyrate resins; vinyl resins such as polyvinyl alcohol and polyvinyl pyrrolidone; and thermoplastic resins such as polyamide.

In order to improve the coating strength and heat resistance of the heat-resistant slip layer, it is preferred to use a cured product formed by a reaction between a thermoplastic resin having an active hydrogen group and an isocyanate.

Particularly preferred resins used in this case are thermoplastic resins having a hydroxyl group. Among them, polyvinylacetal resins, such as polyvinylbutyral resins and polyacetoacetal resins, are preferred.

Various isocyanate curing agents are known in the art, and among them, adducts of aromatic isocyanates are preferred.

Preferred aromatic polyisocyanates include 2,4-toluene diisocyanate, 2,6-toluene diisocyanate, or a mixture of 2,4-toluene diisocyanate with 2,6-toluene diisocyanate, 1,5-naphthalene diisocyanate, tolidine diisocyanate, p-phenylene diisocyanate, trans-cyclohexane 1,4-diisocyanate, xylene diisocyanate, triphenylmethane triisocyanate, and tris(isocyanate phenyl) thiophosphate. Among them, 2,4-toluene diisocyanate, 2,6-toluene diisocyanate, or a mixture of 2,4-toluene diisocyanate with 2,6-toluene diisocyanate are preferred.

Adducts of these polyisocyanates may also be used. The adduct may be prepared using —OH agent, and examples of the —OH agent include monomeric polyols, for example, trimethylolpropane, glycols, polyether polyols, polyester polyols. The use of the adduct of an aromatic isocyanate results in the formation of a heat-resistant slip layer having a better cured film as compared with the use of an isocyanurate. This facilitates bleeding of a lubricant incorporated into the heat-resistant slip layer, offering a good slip property which in turn improves the carriability of the thermal head.

The use of an aromatic isocyanate has the effect of preventing a dye from migrating toward the heat-resistant slip layer facing the dye when the thermal transfer sheet is stored as a rolled sheet. However, it should be noted that the use of other isocyanates, for example, an aliphatic isocyanate (hexamethylene diisocyanate), poses a problem that the dye migrates toward the heat-resistant slip layer facing the dye.

The amount of the polyisocyanate used is suitably 5 to 200 parts by weight based on 100 parts by weight of the binder resin constituting the heat-resistant slip layer. The —NCO to —OH molar ratio is preferably in the range of from 0.8 to 2.0.

When the amount of the polyisocyanate used is excessively small, the crosslinking density is so low that the heat resistance is unsatisfactory. This causes sheet cockle during printing, offering no satisfactory effect. On the other hand, when the amount of the polyisocyanate used is excessively large, it is difficult to control the shrinkage of the coating formed, resulting in problems including that the time necessary for curing is prolonged, an isocyanate group remaining unreacted is left in the heat-resistant slip layer and reacts with moisture in the air, thereby causing sites of crosslinking with the thermoplastic resin having an active hydrogen to be reduced.

The addition of a phosphate ester surfactant to the heat-resistant slip layer is preferred in order to improve the slip property.

Phosphate ester surfactants usable in the present invention include nonionic or anionic phosphate ester surfactants, for example, 1) long-chain alkyl phosphate esters, for example, mono- and/or diesters of saturated or unsaturated higher alcohols having generally 6 to 20 carbon atoms, preferably 12 to 18 carbon atoms, e.g., cetyl alcohol, stearyl alcohol, and oleyl alcohol, with phosphoric acid;
2) phosphate esters of polyoxyalkylene alkyl ethers or polyoxyalkylene alkylaryl ethers; and
3) alkylene oxide adducts (number of moles added: usually 1 to 8) of the above saturated or unsaturated alcohols or phosphate mono- or diesters of alkylphenol or alkylnaphthol having at least one, preferably one or two alkyl groups with 8 to 12 carbon atoms (nonylphenol, dodecylphenol, diphenylphenol and the like).

The above phosphate ester surfactant may be used alone. Since, however, it has 1 to 2 equivalents of an acid group, corrosion of the thermal head occurs. Further, an increase in the amount of heat from the thermal head gives rise to decomposition of the phosphate ester and, further, lowering in pH, resulting in remarkable corrosive wear of the thermal head.

The above drawback can be eliminated by the use of an alkaline substance in combination with the phosphate ester surfactant. Specifically, even though the phosphate ester surfactant is decomposed by heat from the thermal head to give an acid group, the acid group is neutralized with the alkaline substance, preventing the thermal head from being attacked by the acid group.

Examples of the alkaline substance include oxides or hydroxides of alkali metals or alkaline earth metals and/or organic amines.

Preferred examples of the oxide or hydroxide of the alkali metal or alkaline earth metal include magnesium hydroxide, magnesium oxide, hydrotalcite, aluminum hydroxide, aluminum silicate, magnesium silicate, magnesium carbonate, alumina hydroxide, magnesium aluminum glycinate. Among them, magnesium hydroxide is particularly preferred.

Preferred examples of the organic amine include mono-, di-, or trimethylamine, mono-, di-, or triethylamine, mono-, di-, or tripropylamine, mono-, di-, or tributylamine, mono-, di-, or tripentylamine, trihexylamine, trioctylamine, monodecylamine, mono- or didodecylamine, monotridecylamine, monoteradecylamine, monopentadecylamine, monohexadecylamine, monoheptadecylamine, monooctadecylamine, monoeicosylamine, monodocosylamine, mono-, di-, or triethanolamine, mono- or dipropanolamine, monoisopropanolamine, N-methyl-nonylamine, N-methyl-decylamine, and N-ethyl-palmitylamine. Particularly preferred are organic amines which are nonvolatile at room temperature and have a boiling point of 200° C. or above.

These amines can stably exist in the heat-resistant slip layer, and when heat is applied to the heat-resistant slip layer by the thermal head, they become fluid and bleed out on the surface of the heat-resistant slip layer to easily neutralize the acid group produced in the phosphate ester surfactant or a decomposition product thereof, thereby preventing the corrosion of the thermal head and, at the same time, developing excellent lubricity in cooperation with the phosphate ester surfactant.

Preferably, the alkaline substance is used in an amount of 0.1 to 10 moles per mole of the phosphate ester surfactant. When the amount of the alkaline substance is excessively small, the neutralization becomes unsatisfactory, resulting in no satisfactory curing. On the other hand, when it is excessively large, the effect is saturated.

The particles incorporated into the heat-resistant slip layer are characterized in that the shot-type abrasion loss is 15 to 100 mg, preferably 20 to 40 mg.

When the abrasion loss is lower than 15 mg, the particles are so soft that they are collapsed upon the application of heat or pressure during printing, causing collection of sheet debris or sticking. On the other hand, when it is exceeds 100 mg, the abrasion resistance of the thermal head is deteriorated.

Further, when the shot-type abrasion loss is in the above range, the particles have hardness high enough to scrape off sheet debris, if any, on the thermal head, preventing the collection of the sheet debris on the thermal head.

In the present invention, regarding particles incorporated into the heat-resistant slip layer, a single type of particles having a shot-type abrasion loss falling within the above range may be used. Alternatively, two or more types of particles may be used as a mixture so as for the shot-type abrasion loss of the mixture to be in the range of from 5 to 100 mg.

When two types of particles are used as a mixture, what is required is that the resultant mixture has a shot-type abrasion loss falling within the specified range. Specifically, two types of particles having the specified shot-type abrasion loss may be mixed together. Alternatively, particles having the specified shot-type abrasion loss may be mixed with particles outside the specified shot-type abrasion loss range to give a mixture having a shot-type abrasion loss falling within the specified range.

The term "shot-type abrasion loss" used herein is intended to mean a loss in weight of shots as measured by the following method. A powder to be measured, together with water and shots, is placed in a measuring glass tube, the glass tube is rotated by a predetermined number of revolutions, and the weight of the shots is then measured to determine the loss in weight of the shots caused by abrasion. The abrasion loss is specified by this value. The shots used in this test are shots of lead balls (2A) specified in JIS. That is, the shots of lead balls are available under the trade name "shots 2A" manufactured by Nikkosha Kogyo K.K., Japan.

Examples of particles having a shot-type abrasion loss of 15 to 100 mg include inorganic fine particles of clay minerals, such as talc and kaolin, carbonates, such as calcium carbonate and magnesium carbonate, hydroxides, such as aluminum hydroxide and magnesium hydroxide, sulfates such as calcium sulfate, oxides, such as silica, graphite, niter, and boron nitride; fine particles of organic resins, for example, acrylic resins, teflon resins, silicone resins, lauroyl resins, phenolic resins, acetal resins, polystyrene resins, and nylon resins; or fine particles of crosslinked resins prepared by reacting the above resin with a crosslinking agent.

The above inorganic particles are, in some cases, outside the above specified shot-type abrasion loss due to the presence of impurities. Therefore, care should be given in selecting the inorganic fine particles.

Preferably, the particles are used in an amount of 5 to 40 parts by weight based on 100 parts by weight of the binder resin. When the amount of the particles added is excessively small, the slip properties are unsatisfactory. On the other hand, when it is excessively large, the flexibility and coating strength of the heat-resistant slip layer are deteriorated.

In the present invention, lubricants, such as wax, silicone oil, higher fatty acid amide, esters, and surfactants, may be added so far as they are not detrimental to the object of the present invention.

The heat-resistant slip layer may be provided on a substrate sheet by dissolving the above ingredients in a suitable solvent, such as acetone, methyl ethyl ketone, toluene, or xylene, to prepare an ink for a heat-resistant slip layer and then coating the ink onto a substrate sheet by a conventional appropriate printing or coating method using a gravure coater, roll coater, wire bar or the like to form a coating which is then heated to a temperature of 30 to 100° C., thereby drying the coating and, at the same time, reacting the resin having an active hydrogen with an isocyanate to form a heat-resistant slip layer.

The thickness of the heat-resistant slip layer is preferably 0.5 to 5 μm, still preferably 1 to 2 μm. When the layer thickness is less than 0.5 μm, the heat-resistant slip layer cannot sufficiently offer the contemplated effect. On the other hand, when it exceeds 5 μm, the heat transfer from the thermal head to the dye layer is deteriorated, resulting in lowered print density.

When the heat-resistant slip layer is provided on the substrate sheet, heat is preferably applied to accelerate the reaction of the binder resin with the isocyanate. In this case, in order to avoid the influence of heat on the dye layer, it is preferred to provide the dye layer after the provision of the heat-resistant slip layer on the substrate sheet.

Basically, the thermal transfer sheet of the present invention has the above construction. In addition, a primer layer may be provided between the dye layer and the substrate sheet or between the heat-resistant slip layer and the substrate sheet from the viewpoint of improving the adhesion between layers.

The primer layer may be formed of any conventional material. When the substrate sheet is formed of a polyester, the provision of a primer layer formed of, for example, an acrylic resin, a polyester resin, or a combination of a polyol with a diisocyanate can improve the adhesion.

Further, if necessary, an antistatic agent may be added to at least one of the substrate, the primer layer, the heat-resistant slip layer, and the thermal transfer layer. The antistatic agent used herein may be suitably selected by taking into consideration the compatibility with the resin used in the substrate film, dye layer, or heat-resistant slip layer, migration, heat stability, processability, and other fundamental properties such as film strength. Among others, surfactants are preferred from the viewpoints of low cost and excellent processability.

Examples of surfactants used as the antistatic agent include, for use as a cationic antistatic agent, primary amine salts, tertiary amines, quaternary ammonium compounds, pyridine derivatives, and sulfonate compounds; for use as an anionic antistatic agent, sulfated ester oils, such as sodium ricinoleic sulfate, soaps, such as fatty acid salts, sulfated ester oils, such as sodium lysylate sulfate, sulfated amide oils, such as sulfated ethyl oleate aniline, fatty alcohol sulfates, such as sulfates of olefins and sodium oleyl alcohol sulfate, alkylsulfates, fatty acid ethylsulfates, alkylsulfonates, a mixture of naphthalenesulfonic acid with formalin, succinate sulfonates, and phosphates; for use as a nonionic antistatic agent, partial esters of fatty acids with polyhydric alcohols, such as sorbitan monofatty acid esters and fatty acid pentaerythritol, aliphatic alcohols, fatty acids, fatty aminos, aliphatic acid amides, alkylphenols, and alkylnaphthols, ethylene oxide adducts of partial esters of fatty acids with polyhydric alcohols, and polyethylene glycol; and, for use as an amphoteric antistatic agent, carboxylic acid derivatives, imidazoline derivatives and the like.

When the heat-resistant slip layer is composed mainly of a silicone resin having no reactivity, the antistatic agent may be selected without taking into consideration the influence of a reaction of the antistatic agent with the heat-resistant slip layer. On the other hand, when the heat-resistant slip layer is composed mainly of a binder resin comprising an isocyanate and a resin reactive with the isocyanate, the selection of an antistatic agent containing an active hydrogen is unsuitable because such an antistatic agent affects the reaction of the isocyanate in the formation of a heat-resistant slip layer. In this respect, the use of antistatic agents other than cationic surfactants except for sulfonate compounds are preferred.

For example, in the case of a substrate film formed of polyethylene terephthalate, i.e., a polyester, fine particles are milled into the resin, the mixture is melt-extruded by a T-die process into a nonoriented film which is then biaxially oriented by means of a successive biaxial orienting machine of a tenter type to provide a final biaxially oriented film.

In the case of polyethylene terephthalate, this resin is extruded through a T-die at a temperature of about 290 to 320° C. into a film in a melted state which is then rapidly cooled and solidified on a casting drum to prepare a nonoriented film. In this case, the use of electrostatic contact is preferred from the viewpoint of holding the film on the drum.

The biaxial orientation can be classified roughly into successive biaxial orientation and simultaneous biaxial orientation. The successive biaxial orientation is generally used from the viewpoint of efficiency and the like. In the successive biaxial orientation, it is common practice to first orient the film in the flow direction (longitudinal direction) and then orient the film in the width direction (transverse direction). At the outset, the nonoriented film is heated to a temperature of 80 to 90 ° C. and oriented 2.5 to 4.5 times by means of a stretching machine for longitudinal orientation. The orientation is carried out by taking advantage of a difference in speed between rolls. Then, the film is heated to a temperature of 95 to 110° C. by means of a tenter and oriented about 3 to 4 times. Thereafter, the oriented film is then exposed to hot air of 180 to 260° C. for 2 to 5 sec for crystallization and removal of residual strain, thereby improving the heat resistance.

When the film is oriented in the longitudinal direction, then in the transverse direction, and again in the longitudinal direction, or when the film is oriented in the longitudinal direction after the orientation in the transverse direction, it is possible to prepare a film having high strength particularly in the longitudinal direction.

The thermal transfer sheet may be in a sheet form cut into a desired dimension or alternatively in a continuous or roll form. Further, it may be in a small-width tape.

A receiving material used for forming an image utilizing the thermal transfer sheet as described above, for example, in the case of a dye sublimation thermal transfer sheet, may be any material so far as the recording face is receptive to the above dyes. When the receiving material is paper, metals, glass, and synthetic resins, which are unreceptive to a dye, a dye-receptive layer may be formed on one side of such a material.

The receiving material on which the formation of a dye-receptive layer is not required may be any material commonly used in the art, and examples thereof include fibers, woven fabrics, films, sheets, moldings and the like of polyolefin resins such as polyethylene and polypropylene; halogenated polymers such as polyvinyl chloride and polyvinylidene chloride; vinyl polymers such as polyvinyl acetate and polyacrylic esters; polyester resins such as polyethylene terephthalate and polybutylene terephthalate; polystyrene resins; polyamide resins; copolymer resins of an olefin, such as ethylene or propylene, with other vinyl monomer; ionomers; cellulosic resins such as cellulose acetate: polycarbonates; polysulfones; polyimides; and the like.

Particularly preferred are a sheet or a film formed of a polyester and a converted paper with a polyester layer formed thereon. When the material to be used as a receiving material is formed of paper, a metal, glass, or other undyable material, a solution or a dispersion of a dyable resin as described above may be coated onto the recording face and dried to render the material usable as the receiving material. Alternatively, a film of a dyable resin may be laminated onto the undyable material to render the undyable material usable as the receiving material.

Further, even in the case of a dyable receiving material, a dye-receptive layer formed of a resin having better dyability may be formed on the receiving material in the same manner as described above in connection with paper.

The dye-receptive layer may be formed of a single material or a plurality of materials. Further, it may contain various additives so far as it does not adversely affect the attainment of the contemplated object.

Although the thickness of the dye-receptive layer may be any one, it is generally in the range of from 3 to 50 $\mu$m. The dye-receptive layer is preferably in the form of a continuous coating. It is also possible to form the dye-receptive layer as a discontinuous coating using a resin emulsion or a resin dispersion.

The receiving material is basically as described above and, as such, may be satisfactorily used. Further, it is also possible to incorporate an inorganic powder, for anti-sticking purposes, into the receiving material or the dye-receptive layer of the receiving material. This prevents blocking between the thermal transfer sheet and the receiving material even when the temperature for thermal transfer is raised, resulting in better thermal transfer. Finely divided silica is particularly preferred.

Furthermore, a resin having better releasability may be used instead of or in combination with the inorganic powder such as silica. Particularly preferred examples of the releasable polymer include a cured product of a silicone compound, for example, a cured product of an epoxy-modified silicone oil and an amino-modified silicone oil. The releasable polymer is used in an amount of about 0.5 to 30% by weight based on the weight of the dye-receptive layer.

The above inorganic powder may be adhered onto the surface of the dye-receptive layer of the receiving material used to enhance the anti-sticking effect. Further, the above releasable layer formed of a releasable polymer having excellent releasability may be provided on the receiving material.

A thickness of about 0.01 to 5 $\mu$m suffices for attaining the effect of the release layer, i.e., attaining a further improvement in receptivity to a dye while preventing blocking between the thermal transfer sheet and the dye-receptive layer.

Second Invention

A material for the substrate sheet constituting the thermal transfer sheet of the second invention is not particularly limited and may be any conventional one so far as it has satisfactory heat resistance and strength. Examples of the substrate sheet include 0.5 to 50 $\mu$m-thick, preferably 3 to 10 $\mu$m-thick films of resins, for example, polyesters, 1,4-polycyclohexylene dimethylene terephthalate, polyethylene naphthalate, polyphenylene sulfide, polyethylene, polypropylene, polysulfone, aramid, polycarbonate, polyvinyl alcohol, cellophane, cellulose derivatives, such as cellulose acetate, polyethylene, polyvinyl chloride, nylon, polyimide, and ionomers. In addition, it may be formed of paper, such as capacitor paper or paraffin paper, nonwoven fabric, or a composite of paper or nonwoven fabric and a resin.

If necessary, an adhesive layer (primer layer) may be preferably provided on one side or both sides of the substrate film.

The thermal transfer sheet of the present invention comprises: a substrate; a heat-transferable colorant layer provided on one side of the substrate; and a heat-resistant slip layer, containing a resin binder and an inorganic filler, provided on the side of the substrate remote from the heat-transferable colorant layer. The inorganic filler comprises a main component and an impurity, the hardness of the main component and the hardness of the impurity having the relationship: main component<impurity, and the ratio of the highest diffraction line intensity Y of the impurity to the highest diffraction line intensity X of the main component in the X-ray diffraction of the inorganic filler being $0.03 \leqq Y/X \leqq 0.20$.

A binder resin used for the formation of the heat-resistant slip layer is not particularly limited, and a thermoplastic resin and a thermosetting resin, either alone or in combination, may be used.

When the resin has a reactive group or an improvement in heat resistance is contemplated, a product of a reaction with various isocyanate curing agents or a product of a reaction with a monomer or an oligomer having an unsaturated bond may also be used. Curing may be carried out by any method without limitation, such as heating or ionizing radiation irradiation.

Preferred binder resins include polyester resins, polyacrylic ester resins, polyvinyl acetate resins, styrene acrylate resins, polyurethane resins, polyolefin resins, polystyrene resins, polyvinyl chloride resins, polyether resins, polyamide resins, polycarbonate resins, oleaginous polyols, polyethylene glycol, polyethylene resins, polypropylene resins, polyacrylate resins, polyacrylamide resins, polyvinyl chloride resins, polyvinyl butyral resins, and polyvinyl acetoacetal resins. Among them, polyvinyl acetal resins, such as polyvinyl butyral resins and polyvinyl acetoacetal resins, are particularly preferred.

Regarding a curing agent for use in combination with the binder resin, when a polyisocyanate is used as a crosslinking agent, the polyisocyanate may be any conventional one commonly used in paints, adhesives or synthesis of a polyurethane.

Commercially available polyisocyanate compounds used in the present invention include, for example, Takenate (manufactured by Takeda Chemical Industries, Ltd.), Burnock (manufactured by Dainippon Ink and Chemicals, Inc.), Coronate (manufactured by Nippon Polyurethane Industry Co., Ltd.), Duranate (manufactured by Asahi Chemical Industry Co., Ltd.), and Desmodur (manufactured by Bayer).

The amount of the polyisocyanate added is suitably in the range of from 5 to 280 parts by weight based on 100 parts by weight of the binder resin constituting the slip layer. The —NCO to —OH ratio is preferably in the range of from 0.6 to 2.0.

When the amount of the polyisocyanate used is insufficient, the crosslinking density becomes so low that the heat resistance is deteriorated. On the other hand, when it is excessively large, the shrinkage of the coating formed cannot be controlled, requiring a prolonged curing time. Further, in some cases, unreacted —NCO group is left in the heat-resistant slip layer and reacts with moisture in the air to cause sites of crosslinking with the thermoplastic resin having an active hydrogen to be reduced or reacts with a binder resin or a dye in the transferable colorant layer.

On the other hand, when a monomer or an oligomer having an unsaturated bond is used as a crosslinking agent, curing may be carried out by either electron beam irradiation or UV irradiation. When the amount of the filler added is large, curing by electron beam irradiation is preferred. Examples of the monomer or oligomer having an unsaturated bond include difunctional monomers such as tetraethylene glycol diacrylate, tetraethylene glycol dimethacrylate, divinylbenzene, and diallyl phthalate; trifunctional monomers such as triallyl isocyanate, trimethylolpropane triacrylate, and trimethylolpropane trimethacrylate; tetramethylolmethane tetraacrylate; tetramethylolmethane tetramethacrylate, trimethoxyethoxyvinylsilane; penta- or higher functional monomers; and oligomers or macromers of above monomers.

A release agent or a lubricant may be incorporated into the heat-resistant slip layer in order to improve the releasability or slip property.

Examples of the release agent or lubricant include phosphate ester surfactants, polyethylene wax, montan wax, dimethylpolysiloxane, methylphenylpolysiloxane, fatty acid amides, fatty acid esters, long-chain aliphatic compounds, low-molecular weight polypropylene, block copolymers of ethylene oxide with propylene oxide, condensates of a fatty acid salt with a polyether compound, perfluoroalkyletylene oxide adducts, nonionic surfactants, such as sorbitan fatty acid ester surfactants, and sodium salt of long-chain alkylsulfonic acids. They may be used alone or as a mixture of two or more.

Phosphate ester surfactants usable in the present invention include nonionic or anionic phosphate ester surfactants, for example, 1) long-chain alkyl phosphate esters, for example, mono- and/or diesters of saturated or unsaturated higher alcohols having generally 6 to 20 carbon atoms, preferably 12 to 18 carbon atoms, e.g., cetyl alcohol, stearyl alcohol, and oleyl alcohol, with phosphoric acid;
2) phosphate esters of polyoxyalkylene alkyl ethers or polyoxyalkylene alkylaryl ethers; and
3) alkylene oxide adducts (number of moles added: usually 1 to 8) of the above saturated or unsaturated alcohols or phosphate mono- or diesters of alkylphenol or alkylnaphthol having at least one, preferably one or two alkyl groups with 8 to 12 carbon atoms (nonylphenol, dodecylphenol, diphenylphenol and the like).

The amount of the above hot release agent or the lubricant added is suitably 1 to 100 parts by weight based on 100 parts by weight of the binder resin, preferably 2 to 50 parts by weight.

When the amount of the hot release agent or lubricant added is excessively small, hot releasability from the thermal head is unsatisfactory, causing sheet cockle during printing, collection of sheet debris, and sticking. On the other hand, when it is excessively large, no satisfactory hot releasability can be attained because the storage of the thermal transfer sheet in a roll form causes the dye of the heat-transferable colorant layer facing the heat-resistant slip layer to be transferred to the heat-resistant slip layer or causes the hot release agent or lubricant of the heat-resistant slip layer to be transferred to the heat-transferable colorant layer. Consequently, no satisfactory hot releasability can be provided, often causing sheet cockle during printing or collection of sheet debris on the thermal head or adverse effect on the color reproduction of prints.

The above phosphate ester surfactant may be used alone. Since, however, it has 1 to 2 equivalents of an acid group, corrosion of the thermal head occurs. Further, an increase in the amount of heat from the thermal head gives rise to decomposition of the phosphate ester and, further, lowering in pH of the heat-resistant slip layer, resulting in remarkable corrosive wear of the thermal head.

The above drawback can be eliminated by the use of an alkaline substance in combination with the phosphate ester surfactant. Specifically, even though the phosphate ester surfactant is decomposed by heat from the thermal head to give an acid group, the acid group is neutralized with the alkaline substance, preventing the thermal head from being attacked by the acid group.

Examples of the alkaline substance include oxides or hydroxides of alkali metals or alkaline earth metals and/or organic amines.

Preferred examples of the oxide or hydroxide of the alkali metal or alkaline earth metal include magnesium hydroxide, magnesium oxide, hydrotalcite, aluminum hydroxide, aluminum silicate, magnesium silicate, magnesium carbonate, alumina hydroxide, magnesium aluminum glycinate. Among them, magnesium hydroxide is particularly preferred.

Preferred examples of the organic amine include mono-, di-, or trimethylamine, mono-, di-, or triethylamine, mono-, di-, or tripropylamine, mono-, di-, or tributylamine, mono-, di-, or tripentylamine, trihexylamine, trioctylamine, monodecylamine, mono- or didodecylamine, monotridecylamine, monoteradecylamine, monopentadecylamine, monohexadecylamine, monoheptadecylamine, monooctadecylamine, monoeicosylamine, monodocosylamine, mono-, di-, or triethanol amine, mono- or dipropanolamine, monoisopropanolamine, N-methyl-nonylamine, N-methyl-decylamine, and N-ethyl-palmitylamine. Particularly preferred are organic amines which are nonvolatile at room temperature and have a boiling point of 200° C. or above.

These amines can stably exist in the heat-resistant slip layer, and when heat is applied to the heat-resistant slip layer by the thermal head, they become fluid and bleed out on the surface of the heat-resistant slip layer to easily neutralize the acid group produced in the phosphate ester surfactant or a decomposition product thereof, thereby preventing the corrosion of the thermal head and, at the same time, developing excellent lubricity in cooperation with the phosphate ester surfactant.

Preferably, the alkaline substance is used in an amount of 0.1 to 10 moles per mole of the phosphate ester surfactant. When the amount of the alkaline substance is excessively small, the neutralization becomes unsatisfactory, resulting in no satisfactory effect. On the other hand, when it is excessively large, the effect is saturated.

The inorganic filler used in the heat-resistant slip layer of the present invention will now be described.

The inorganic filler preferably suffices for providing a good heat-resistant slip layer which offers excellent slip property and releasability, good thermal head carriability and causes none of sticking, cockle, breaking of the thermal transfer sheet and abrasion of the thermal head.

For this purpose, inorganic fillers having suitable hardness should be selected. Inorganic fillers usable in the present invention include talc, kaolin clay, calcium carbonate, magnesium hydroxide, magnesium carbonate, precipitated barium phosphate, and hydrotalcite. Among them, inorganic fillers, which are cleavable and have low hardness, such as talc, kaolin, and clay, are preferred.

The type and amount of impurities contained in the inorganic filler are important for specifying the hardness of the inorganic filler used.

For example, talc has a Mohs hardness of 1. Since, however, talc is a natural mineral, properties such as whiteness and particle diameter vary depending upon the place of production, so that talc is of various grades. This is attributable greatly to the purity of talc. X-ray diffraction reveals that the impurity content varies from talc to talc. Impurities contained in the talc include dolomite and magnesite. The hardness of the filler increases with increasing the content of the impurity. Regarding the Mohs hardness of the impurity, dolomite and magnesite are both 3.5 to 4. Therefore, the talc and the impurity have the following hardness relationship: (hardness of talc)<(hardness of impurity).

As a result of X-ray diffraction of various types of talc, it was found that the ratio of the highest diffraction line intensity Y of the impurity to the highest diffraction line intensity X of the talc was $0.001 \leqq Y/X \leqq 0.40$. Further studies have revealed that a good heat-resistant slip layer, which has excellent slip property and releasability, offers excellent thermal head carriability, causes none of sticking, cockle, and breaking, and is less likely to abrade the thermal head, can be provided when the ratio is preferably $0.03 \leqq Y/X \leqq 0.20$, still preferably $0.10 \leqq Y/X \leqq 0.15$.

When the Y/X value is less than 0.3, sticking or cockle is likely to occur, while when it exceeds 0.20, the abrasion of the thermal head is likely to become significant.

In selecting such an inorganic filler, a single inorganic filler having a Y/X value falling within the above range may be used. Alternatively, two or more inorganic fillers may be used as a mixture so as for the overall Y/X value of the mixture to fall within the specified Y/X range. In this case, two or more inorganic fillers each falling within the specified Y/X value range may be mixed together. Alternatively two or more inorganic fillers each outside the specified Y/X value range may be mixed together to give a mixture falling within the specified Y/X value range. Further at least one inorganic filler falling within the specified Y/X range may be mixed with at least one inorganic filler outside the specified Y/X range to give a mixture falling within the specified Y/X range. That is, the mixture may be prepared by any method without limitation.

The filler used in the present invention is not limited to an inorganic filler, and an organic filler may be used in combination with the above in organic filler, provided that it is less likely to abrade the thermal head and causes neither fusing to the thermal head upon heating nor collection of debris on the thermal head.

The heat-resistant slip layer may be formed by dissolving or dispersing the above material in a solvent, such as acetone, methyl ethyl ketone, toluene, or xylene, selected so as to be compatible with contemplated coatability to prepare a coating solution, coating the coating solution by any conventional coating means, such as a gravure coater, a roll coater, or a wire bar, and drying and solidifying the coating.

A coverage, i.e., a thickness of the heat-resistant slip layer, of not more than 3.0 $g/m^2$ on a dry basis, preferably 0.1 to 1.0 $g/m^2$ on a dry basis suffices for forming a heat-resistant slip layer having satisfactory performance.

When a polyisocyanate is used in combination with other ingredients constituting the heat-resistant slip layer, an unreacted isocyanate, after coating and drying of a heat-resistant slip layer, is, in many cases, present in the heat-resistant slip layer. Therefore, heating and aging treatment are preferably carried out in order to complete the reaction. Further, it is also useful to provide a primer layer prior to the formation of the heat-resistant slip layer.

The heat-transferable colorant layer formed on the opposite side of the substrate sheet may be prepared by forming a layer containing a sublimable dye when the thermal transfer sheet is of a dye sublimation type or by forming a layer using a hot-melt ink colored with a pigment or the like when the thermal sheet is of a hot-melt type. The dye sublimation thermal transfer sheet will now be described in detail as a representative example, though the present invention is not limited to the dye sublimation thermal transfer sheet. The dye in the heat-transferable colorant layer is not particularly limited, and any conventional dye used in the thermal transfer sheet can be used in the present invention.

Preferred examples of red dyes include MS Red G., Marcrolex Red Violet R, Ceres Red 7B, Samaron Red HBSL., and Resolin Red F3BS. Preferred examples of yellow dyes include Foron Brilliant Yellow 6GL and PTY-52 and Macrolex Yellow 6G., and preferred examples of blue dyes include Kayaset Blue 714, Waxoline Blue P-FW, Foron Brilliant Blue S-R, and MS Blue 100.

Binder resins for holding the above resins include cellulosic resins such as ethyl cellulose hydroxyethyl cellulose, hydroxypropyl cellulose, methyl cellulose, cellulose acetate, and cellulose acetate butyrate; vinyl resins such as polyvinyl alcohol, polyvinyl acetate, polyvinyl butyral, polyvinyl acetoacetal, polyvinylpyrrolidone; acrylic resins such a polyacrylate, polymethacrylate, polyacrylamide, and polymethacrylamide; polyurethane resins; formamide resins; and polyester resins. Among them, cellulosic, vinyl, acrylic, polyurethane, polyester and other resins ar preferred from the viewpoint of heat resistance, transferability of dyes and the like.

The dye layer may be formed by coating one side of the above substrate sheet with a suitable organic solvent solution or an organic solvent or water dispersion of the above dye and binder and optional additive, for example, a release agent or organic or inorganic fine particles, for example, by gravure printing, screen printing, reverse roll coating or the like and drying the coating.

The thickness of the dye layer is generally 0.2 to 5.0 pm, preferably about 0.4 to 2.0 $\mu$m, and the content of the sublimable dye in the dye layer is generally 5 to 90% by weight, preferably 10 to 70% by weight, based on the weight of the dye layer.

When the formation of a monochrome image from the heat-transferable colorant layer is contemplated, one dye selected from the above dyes is used to form the heat-transferable colorant layer. On the other hand, when the formation of a full-color image from the heat-transferable colorant layer is contemplated, suitable cyan, magenta, and yellow (and, if necessary, black) dyes are selected and used to form the heat-transferable colorant layer.

An image-receiving sheet is used to form an image utilizing the thermal transfer sheet. The image-receiving sheet may be any sheet so far as it has receptivity to the above dyes. When the use of paper, metals, glass, synthetic resins and the like, which are unreceptive to dyes, is contemplated, a dye-receptive layer may be formed on at least one side of these materials.

When the thermal transfer sheet is of a hot-melt type, the receiving material is not particularly limited and may be any conventional paper and plastic film.

A printer used in thermal transfer the above thermal transfer sheet and the above image-receiving sheet is not particularly limited, and conventional thermal printers, as such, may be usable.

The thermal transfer sheets of the present invention will now be described in more detail with reference to the following examples and comparative examples. In the following examples and comparative examples, "parts" or "%" is by weight unless otherwise specified.

EXAMPLE A1

A polyethylene terephthalate film (K203E4.5W, thickness 4.5 μm; manufactured by Diafoil Hoechist Co., Ltd.) was provided as a substrate film. A coating solution, for a heat-resistant slip layer, having the following composition was coated on one side of the substrate by means of Mayer bar #5 to a thickness on a dry basis of 1 μm, and the coating was then dried and heat-aged at 60° C. in an oven for 2 days to cure the coating, thereby forming a heat-resistant slip layer.

| Coating solution for heat-resistant slip layer | |
|---|---|
| Polyvinyl butyral (S-lec BX-1, manufactured by Sekisui Chemical Co., Ltd.) | 3.6 parts |
| Polyisocyanate (Burnock D750, manufactured by Dainippon Ink and Chemicals, Inc.) | 8.4 parts |
| Phosphate ester surfactant (Plysurf A208S, manufactured by Dai-Ichi Kogyo Seiyaku Co., Ltd.) | 2.8 parts |
| Oleaginous polyol (Olefter C1066, manufactured by Mitsui Toatsu Chemicals, Inc.) | 0.9 part |
| Talc (manufactured by Nippon Talc Co., Ltd.) (shot-type abrasion loss = 15 mg) | 0.6 part |
| Magnesium hydroxide (Kisuma 5A, inanufactured by Kyowa Chemical Industry, Co., Ltd.) | 0.3 part |
| Toluene | 85 parts |
| Methyl ethyl ketone | 85 parts |

Then, the following coating solution for a dye layer was coated on the side of substrate film remote from the heat-resistant slip layer by means of Mayar bar #10 to a thickness on a dry basis of 1 μm, and the coating was then dried to prepare a thermal transfer sheet of the present invention.

| Coating solution for dye layer | |
|---|---|
| C. I Solvent Blue 22 | 5.5 parts |
| Polyvinyl acetone acetal resin (S-lec KS-5, manufactured by Sekisui Chemical Co., Ltd.) | 3.0 parts |
| Polyethylene wax (AF31, manufactured by BASF) | 0.1 part |
| Toluene | 68.2 parts |
| Methyl ethyl ketone | 22.5 parts |

EXAMPLE A2

A thermal transfer sheet was prepared in the same manner as in Example A1, except that the coating solution for a heat-resistant slip layer had the following composition.

| Coating solution for heat-resistant slip layer | |
|---|---|
| Polyvinyl butyral (S-lec BX-1, manufactured by Sekisui Chemical Co., Ltd.) | 3.6 parts |

-continued

| Coating solution for heat-resistant slip layer | |
|---|---|
| Polyisocyanate (Burnock D750, manufactured by Dainippon Ink and Chemicals, Inc.) | 8.4 parts |
| Phosphate ester surfactant (Plysurf A208S, manufactured by Dai-Ichi Kogyo Seiyaku Co., Ltd.) | 2.8 parts |
| Kaolin clay (manufactured by ECC Japan Ltd.) (shot-type abrasion loss = 26.2 mg) | 0.6 part |
| Magnesium hydroxide (Kisuma 5A, manufactured by Kyowa Chemical Industry, Co., Ltd.) | 0.3 part |
| Toluene | 85 parts |
| Methyl ethyl ketone | 85 parts |

EXAMPLE A3

A thermal transfer sheet was prepared in the same manner as in Example A1, except that the coating solution for a heat-resistant slip layer had the following composition.

| Coating solution for heat-resistant slip layer | |
|---|---|
| Polyvinyl butyral (S-lec BX-1, manufactured by Sekisui Chemical Co., Ltd.) | 3.6 parts |
| Polyisocyanate (Burnock D750, manufactured by Dainippon Ink and Chemicals, Inc.) | 8.4 parts |
| Phosphate ester surfactant (Plysurf A208S, manufactured by Dai-Ichi Kogyo Seiyaku Co., Ltd.) | 2.8 parts |
| Polyethylene glycol (PEG 600, manufactured by Nippon Oils & Fats Co., Ltd.) | 0.9 part |
| Talc (manufactured by Nippon Talc Co., Ltd.) (shot-type abrasion loss = 51.6 mg) | 0.6 part |
| Magnesium hydroxide (Kisuma 5A, manufactured by Kyowa Chemical Industry, Co., Ltd.) | 0.3 part |
| Toluene | 85 parts |
| Methyl ethyl ketone | 85 parts |

EXAMPLE A4

A thermal transfer sheet was prepared in the same manner as in Example A1, except that the coating solution for a heat-resistant slip layer had the following composition.

| Coating solution for heat-resistant slip layer | |
|---|---|
| Polyvinyl butyral (S-lec BX-1, manufactured by Sekisui Chemical Co., Ltd.) | 3.6 parts |
| Polyisocyanate (Burnock D750, manufactured by Dainippon Ink and Chemicals, Inc.) | 8.4 parts |
| Phosphate ester surfactant (Plysurf A208S, manufactured by Dai-Ichi Kogyo Seiyaku Co., Ltd.) | 2.8 parts |
| Silica (manufactured by Tatsumori Ltd. (shot-type abrasion loss = 96.1 mg) | 0.6 part |
| Magnesium hydroxide (Kisuma 5A, manufactured by Kyowa Chemical Industry, Co., Ltd.) | 0.3 part |
| Toluene | 85 parts |
| Methyl ethyl ketone | 85 parts |

EXAMPLE A5

A thermal transfer sheet was prepared in the same manner as in Example A1, except that the coating solution for a heat-resistant slip layer had the following composition.

| Coating solution for heat-resistant slip layer | |
|---|---|
| Polyvinyl butyral (S-lec BX-1, manufactured by Sekisui Chemical Co., Ltd.) | 3.6 parts |
| Polyisocyanate (Burnock D750, manufactured by Dainippon Ink and Chemicals, Inc.) | 8.4 parts |
| Phosphate ester surfactant (Plysurf A208S, manufactured by Dai-Ichi Kogyo Seiyaku Co., Ltd.) | 2.8 parts |
| Talc (manufactured by Nippon Talc Co., Ltd.) (shot-type abrasion loss = 11 mg) | 0.54 part |
| Talc(manufactured by Nippon Talc Co., Ltd.) | 0.04 part |
| Maqnesium hydroxide (Kisuma 5A, manufactured by Kyowa Chemical Industry, Co., Ltd.) | 0.3 part |
| Toluene | 85 parts |
| Methyl ethyl ketone | 85 parts |

COMPARATIVE EXAMPLE A1

A thermal transfer sheet was prepared in the same manner as in Example A1, except that the coating solution for a heat-resistant slip layer had the following composition.

| Coating solution for heat-resistant slip layer | |
|---|---|
| Polyvinyl butyral (S-lec BX-1, manufactured by Sekisui Chemical Co., Ltd.) | 3.6 parts |
| Polyisocyanate (Burnock D750, manufactured by Dainippon Ink and Chemicals, Inc.) | 8.4 parts. |
| Phosphate ester surfactant (Plysurf A208S, manufactured by Dai-Ichi Kogyo Seiyaku Co., Ltd.) | 2.8 parts |
| Crosslinked acrylic resin particles (MR-7HG, manufactured by Soken Chemical Engineering Co., Ltd.)(shot-type abrasion loss = 10 mg) | 0.6 part |
| Magnesium hydroxide (Kisuma 5A, manufactured by Kyowa Chemical Industry, Co., Ltd.) | 0.3 part |
| Toluene | 85 parts |
| Methyl ethyl ketone | 85 parts |

COMPARATIVE EXAMPLE A2

A thermal transfer sheet was prepared in the same manner as in Example A1, except that the coating solution for a heat-resistant slip layer had the following composition.

| Coating solution for heat-resistant slip layer | |
|---|---|
| Polyvinyl butyral (S-lec BX-1, manufactured by Sekisui Chemical Co., Ltd.) | 3.6 parts |
| Polyisocyanate (Burnock D750, manufactured by Dainippon Ink and Chemicals, Inc.) | 8.4 parts |
| Phosphate ester surfactant (Plysurf A208S, manufactured by Dai-Ichi Kogyo Seiyaku Co., Ltd.) | 2.8 parts |

-continued

| Coating solution for heat-resistant slip layer | |
|---|---|
| Silica (manufactured by Tatsumori Ltd. (shot-type abrasion loss = 178.2 mg) | 0.6 part |
| Magnesium hydroxide (Kisuma 5A, manufactured by Kyowa Chemical Industry, Co., Ltd.) | 0.3 part |
| Toluene | 85 parts |
| Methyl ethyl ketone | 85 parts |

COMPARATIVE EXAMPLE A3

A thermal transfer sheet was prepared in the same manner as in Example A1, except that the coating solution for a heat-resistant slip layer had the following composition.

| Coating solution for heat-resistant slip layer | |
|---|---|
| Polyvinyl butyral (S-lec BX-1, manufactured by Sekisui Chemical Co., Ltd.) | 3.6 parts |
| Polyisocyanate (Burnock D750, manufactured by Dainippon Ink and Chemicals, Inc.) | 8.4 parts |
| Phosphate ester surfactant (Plysurf A208S, manufactured by Dai-Ichi Kogyo Seiyaku Co., Ltd.) | 2.8 parts |
| Calcium carbonate (manufactured by Shiraishi Calcium Kaisha Ltd.) (shot-type abrasion loss = 150.7 mg) | 0.6 part |
| Magnesium hydroxide (Kisuma 5A, manufactured by Kyowa Chemical Industry, Co., Ltd.) | 0.3 part |
| Toluene | 85 parts |
| Methyl ethyl ketone | 85 parts |

The thermal transfer sheets of the above examples and the comparative examples were evaluated for shot-type abrasion loss and carriability within a printer in terms of sticking, collection of sheet debris on the head, and abrasion of the head. The results are given in Table 1. The evaluation was carried out by the following methods.

(i) Shot-type abrasion loss 5 g of particles are weighed, well washed with water, placed in a beaker containing 45 cc of water, and stirred. Shots (2A (Tora Jirushi), manufactured by Nikkosha Kogyo) are well washed with water, and the water is completely wiped off with a dried cloth. The total weight (A) of six shots with water wiped off is accurately measured on a chemical balance. The weighed shots are placed in the beaker containing water and particles. The beaker is set in a shot-type abrasion loss tester (NTL-381-02 type, manufactured by Osaka Kikai) and stirred 37,500 times (about 5.5 hr). The shots are taken out of the beaker, and the water is completely wiped off with a dried cloth. The weight (B) of the six shots is measured on a chemical balance. The value (B) is subtracted from the value (A) to give an abrasion loss.

(ii) Sticking

The thermal transfer sheet is put on the following receiving material so that the dye layer faces the receiving material, and printing of a gradation pattern with 8 gradations was carried out by means of a commercially available video printer (VY-170, manufactured by Hitachi, Ltd.). Whether or not sticking occurred was judged by visual inspection, and the results were evaluated according to the following criteria:

| | |
|---|---|
| Cockle by printing | ○: Not sticked<br>X: Sticked |

The receiving material used for the evaluation of the performance of the thermal transfer sheet was prepared as follows. Specifically, synthetic paper (Yupo FPG150, manufactured by Oji-Yuka Synthetic Paper Co., Ltd.) was provided as a substrate, a coating solution, for a dye-receptive layer, having the following composition was coated on one side thereof by means of a Mayer bar #14 to a thickness on a dry basis of 4 μm, and the coating was dried at 130° C. for 3 min, thereby preparing a receiving material.

| Coating solution for dye-receptive layer | |
|---|---|
| Vinyl chloride/vinyl acetate copolymer resin (Denkalac #1000A, manufactured by Denki Kagaku Kogyo K.K.) | 20 parts |
| Epoxy-modified silicone oil (X-22-3000E, manufactured by The Shin-Etsu Chemica1 Co., Ltd) | 3 parts |
| Amino-modified silicone oil (X-22-3050C, manufactured by The Shin-Etsu Chemical Co., Ltd) | 3 parts |
| Toluene | 40 parts |
| Methyl ethyl ketone | 40 parts |

(iii) Collection of sheet debris on head

Printing was carried out in the same manner as described above in connection with (ii) sticking, and the surface of the thermal head was then observed under a microscope to examine whether or not the collection of sheet debris on the head occurred.

Collection of paper debris on head . . .

○: No collection of sheet debris occurred.

Δ: Some collection of sheet debris occurred.

X: Considerable collection of sheet debris occurred.

(iv) Abrasion of head

Solid printing was carried out using a printer of the same type as used in the evaluation of (ii) sticking, and this was repeated by 3000 image planes. Thereafter, the surface of the thermal head was observed under a microscope to evaluate the abrasion of head.

Abrasion of head . . .

○: No abrasion occurred.

Δ: Some abrasion occurred.

X: Considerable abrasion occurred.

TABLE 1

(Comparison of performance between examples and comparative examples)

| | Shot-type abrasion loss | Sticking | Collection of sheet debris on head | Abrasion of head |
|---|---|---|---|---|
| Ex. A1 | 15 mg | ○ | ○ | ○ |
| Ex. A2 | 26.2 mg | ○ | ○ | ○ |
| Ex. A3 | 51.6 mg | ○ | ○ | ○ |
| Ex. A4 | 96.1 mg | ○ | ○ | ○ |
| Ex. A5 | 21.9 mg | ○ | ○ | ○ |
| Comp. Ex. A1 | 10 mg | X | X | ○ |
| Comp. Ex. A2 | 178.2 mg | ○ | ○ | X |

TABLE 1-continued (Comparison of performance between examples and comparative examples)

| | Shot-type abrasion loss | Sticking | Collection of sheet debris on head | Abrasion of head |
|---|---|---|---|---|
| Comp. Ex. A3 | 150.7 mg | ○ | Δ | Δ |

According to the present invention, when the shot-type abrasion loss of particles contained in the heat-resistant slip layer is brought to 15 to 100 mg, the collection of sheet debris on the printing head caused by collapse of particles by heat or pressure during printing due to excessively high softness of the particles can be prevented. Further, when the particles have a shot-type abrasion loss in the above range, the hardness thereof is high enough to permit sheet debris to be scraped off even through the sheet debris is collected on the printing head.

Further, when the upper limit of the shot-type abrasion loss is 100 mg, it is possible to provide a thermal transfer sheet which does not cause the abrasion of the printing head.

EXAMPLE B1

The following coating composition A for a heat-resistant slip layer was coated on a 4.5 μm-thick polyester film as a substrate sheet to a thickness on a dry basis of 1.0 g/m$^2$, and the resultant coating was dried to form a heat-resistant slip layer.

The following coating composition B for a heat-transferable colorant layer was gravure-printed on the back side of the substrate remote from the heat-resistant slip layer at a coverage on a dry basis of 1.0 g/m$^2$ to form a heat-transferable colorant layer, thereby preparing a thermal transfer sheet of the present invention.

| Coating composition A for heat-resistant slip layer | |
|---|---|
| Polyvinyl butyral resin (S-lec BX-1, manufactured by Sekisui Chemical Co., Ltd.) | 3.6 parts |
| Wax (Kao Wax 230-2, manufactured by Kao Corp.) | 0.7 parts |
| Oleaginous polyol (Olefter C1066, manufactured by Mitsui Toatsu Chemicals, Inc.) | 0.3 part |
| Talc (manufactured by Nippon Talc Co., Ltd.; Y/X = 0.03) | 0.2 part |
| Toluene | 11.0 parts |
| Ethyl acetate | 11.0 parts |
| **Coating composition B for heat-transferable colorant layer** | |
| Cyan dye (C.I. Solvent Blue 22) | 5.5 part |
| Polyvinyl acetoacetal resin | 3.0 parts |
| Methyl ethyl ketone | 22.0 parts |
| Toluene | 68.0 parts |

EXAMPLE B2

A thermal transfer sheet of the present invention was prepared in the same manner as in Example B1, except that, instead of the coating composition A for a heat-resistant slip layer used in Example B1, the following coating composition C for a heat-resistant slip layer was coated and the resultant coating was dried and then heat-aged, thereby curing the coating.

| Coating composition C for heat-resistant slip layer | |
|---|---|
| Polyvinyl butyral resin (S-lec BX-1, manufactured by Sekisui Chemical Co., Ltd.) | 3.6 parts |
| Polyisocyanate (Burnock D750-45, manufactured by Dainippon Ink and Chemicals, Inc.) | 19.2 parts |
| Phosphate ester surfactant (Plysurf A208S, manufactured by Dai-Ichi Kogyo Seiyaku Co., Ltd.) | 2.9 parts |
| Polyether polyol(TG2000, Nippon Oils & Fats Co., Ltd.) | 0.3 part |
| Talc (manufactured by Nippon Talc Co., Ltd.; Y/X = 0.03) | 0.2 part |
| Methyl ethyl ketone | 33.0 parts |
| Toluene | 33.0 parts |

EXAMPLE B3

A thermal transfer sheet of the present invention was prepared in the same manner as in Example B1, except that, instead of the coating composition, for a heat-resistant slip layer, used in Example B1, the following coating composition D, for a heat-resistant slip layer was coated and the resultant coating was dried and irradiated with an electron beam under conditions of accelerated voltage 175 keV and 3 Mrad, thereby curing the coating by crosslinking.

| Coating composition D for heat-resistant slip layer | |
|---|---|
| Polyvinyl butyral resin (S-lec BX-1, manufactured by Sekisui Chemical Co., Ltd.) | 3.6 parts |
| Polyfunctional monomer (Kayarad DPHA, manufactured by Nippon Kayaku Co., Ltd.) | 0.7 part |
| Wax (Kao Wax 230-2, manufactured by Kao Corp.) | 0.8 part |
| Nonionic surfactant (Nonion-0P85R, manufactured by Nippon Oils & Fats Co., Ltd.) | 0.3 part |
| Talc (manufactured by Nippon Talc Co., Ltd.; Y/X = 0.03) | 0.2 part |
| Toluene | 13.0 parts |
| Ethyl acetate | 13.0 parts |

EXAMPLE B4

A thermal transfer sheet of the present invention was prepared in the same manner as in Example B1, except that the following coating solution E for a heat-resistant slip layer was used instead of the coating composition, for a heat-resistant slip layer, used in Example B1.

| Coating composition E for heat-resistant slip layer | |
|---|---|
| Polyvinyl butyral resin (S-lec BX-1, manufactured by Sekisui Chemical Co., Ltd.) | 3.6 parts |
| Wax (Kao Wax 230-2, manufactured by Kao Corp.) | 0.7 part |
| Phosphate ester surfactant (Phosphanol RD720, manufactured by Toho Chemical Industry Co., Ltd.) | 0.3 part |
| Talc (manufactured by Tsuchiya Kaolin Co., Ltd.; Y/X = 0.1) | 0.2 part |
| Toluene | 11.0 parts |
| Ethyl acetate | 11.0 parts |

EXAMPLE B5

A thermal transfer sheet of the present invention was prepared in the same manner as in Example B1, except that the following coating composition F for a heat-resistant slip layer was used instead of the coating solution, for a heat-resistant slip layer, used in Example B1.

| Coating composition F for heat-resistant slip layer | |
|---|---|
| Polyvinyl butyral resin (S-lec BX-1, manufactured by Sekisui Chemica1 Co., Ltd.) | 3.6 parts |
| Wax (Kao Wax 230-2, manufactured by Kao Corp.) | 0.7 part |
| Polyethylene glycol (PEG 600, manufactured by Nippon Oils & Fats Co.; Ltd.) | 0.3 part |
| Talc (mixture of 0.16 part of talc having Y/X = 0.03 and 0.04 part of talc having Y/X = 0.40; both manufactured by Nippon Talc Co., Ltd.; Y/X (as mixture) = 0.2) | 0.2 part |
| Toluene | 11.0 parts |
| Ethyl acetate | 11.0 parts |

COMPARATIVE EXAMPLE B1

A thermal transfer sheet of the present invention was prepared in the same manner as in Example B1, except that, instead of the coating composition , for a heat-resistant slip layer, used in Example B1, the following coating composition G for a heat-resistant slip layer was coated and the resultant coating was dried and heat-aged, thereby curing the coating.

| Coating composition G for heat-resistant slip layer | |
|---|---|
| Polyvinyl butyral resin (S-lec BX-1, manufactured by Sekisui Chemical Co., Ltd.) | 3.6 parts |
| Polyisocyanate (Burnock D750-45, manufactured by Dainippon Ink and Chemicals, Inc.) | 19.2 parts |
| Phosphate ester surfactant (Plysurf A208S, manufactured by Dai-Ichi Kogyo Seiyaku Co., Ltd.) | 2.9 parts |
| Polyethylene glycol (PEG, manufactured by Nippon Oils & Fats Co., Ltd.) | 0.3 part |
| Talc (manufactured by Takehara Chemical Industrial Co., Ltd.; Y/X = 0.30) | 0.2 part |
| Methyl ethyl ketone | 33.0 parts |
| Toluene | 33.0 parts |

COMPARATIVE EXAMPLE B2

A thermal transfer sheet of the present invention was prepared in the same manner as in Example B1, except that, instead of the coating composition, for a heat-resistant slip layer, used in Example B1, the following coating composition H for a heat-resistant layer was coated and the resultant coating was dried and heat-aged, thereby curing the coating.

| Coating composition H tor heat-res1stant slip layer | |
|---|---|
| Polyvinyl butyral resin (S-lec BX-1, manufactured by Sekisui Chemical Co., Ltd.) | 3.6 parts |
| Polyisocyanate (Burnock D750-45, manufactured by Dainippon Ink and Chemicals, Inc.) | 19.2 parts |
| Phosphate ester surfactant (Plysurf A208S, manufactured by Dai-Ichi Kogyo Seiyaku Co., Ltd.) | 2.9 parts |

-continued

| Coating composition H tor heat-res1stant slip layer | |
|---|---|
| Oleaginous polyol (Olefter C1066, manufactured by Mitsui Toatsu Chemicals, Inc.) | 0.3 part |
| Talc (manufactured by Nippon Talc Co., Ltd.; Y/X = 0.003) | 0.2 part |
| Methyl ethyl ketone | 33.0 parts |
| Toluene | 33.0 parts |

COMPARATIVE EXAMPLE B3

A thermal transfer sheet of the present invention was prepared in the same manner as in Example B1, except that, instead of the coating composition, for a heat-resistant slip layer, used in Example B1, the following coating composition I for a heat-resistant layer was coated and the resultant coating was dried and heat-aged, thereby curing the coating.

| Coating composition I for heat-resistant slip layer | |
|---|---|
| Polyvinyl butyral resin (S-lec BX-1, manufactured by Sekisui Chemical Co., Ltd.) | 3.6 parts |
| Polyisocyanate (Burnock D750-45, manufactured by Dainippon Ink and Chemicals, Inc.) | 19.2 parts |
| Phosphate ester surfactant (Plysurf A208S, manufactured by Dai-Ichi Kogyo Seiyaku Co., Ltd.) | 2.9 parts |
| Oleaginous polyol (Olefter C1066, manufactured by Mitsui Toatsu Chemicals, Inc.) | 0.3 part |
| Talc (manufactured by Nippon Talc Co., Ltd.; Y/X = 0.40) | 0.2 part |
| Methyl ethyl ketone | 33.0 parts |
| Toluene | 33.0 parts |

The ratio of the highest diffraction line intensity Y of impurity to the highest diffraction line intensity X of talc, Y/X ratio, described in the above examples and comparative examples was determined by X-ray diffraction of the filler used.

The X-ray diffraction was carried out under the following conditions.

Measuring apparatus: RAD-2D (manufactured by Rigaku Industrial Corp.)

Measuring method: focused circle method/reflection method

Target: Cu

Tube voltage: 40 kV

Tube current: 40 mA

Slit: DS1° SS1° RS 0.15 mm

Sampling angle: 0.020°

Scanning speed: 1° /min (Evaluation method)

Evaluation of sticking: test 1

10 sheets of a step pattern with 8 gradations were continuously printed using a commercially available video printer and a pattern generator (CG-931, manufactured by Kenwood Corp.), which are likely to cause sticking, to determine the frequency of sticking. The printing was carried out in an environment of 30° C. and 80% RH. (Number of sheets which caused sticking)/10 sheets Evaluation of long-run printing: test 2

A deep solid pattern was continuously printed using a commercially available video printer and a pattern generator (CG-931, manufactured by Kenwood Corp.), and the abrasion of the protective layer in a thermal head was observed after printing of 5000 sheets to judge the abrasion of the thermal head.

○: No noticeable abrasion occurred.

Δ: Some abrasion occurred.

X: Remarkable abrasion occurred (to such an extent that the original shape is completely lost).

Evaluation of cockle in print: test 3

Pale color solid printing was carried out and evaluated at 30° C. and 80% RH by means of a pattern generator (CG-931, manufactured by Kenwood Corp.) using a printer wherein the thermal head had been regulated so as to give an unsymmetrical pressure high enough to facilitate the occurrence of cockle in a print.

○: No cockle was observed in a print.

Δ: Fine cockle was observed at the end.

X: Large cross-cockle was observed.

The results are given in Table 2.

TABLE 2

| | X-ray diffraction | | | Evaluation of print | | |
|---|---|---|---|---|---|---|
| | Main component(X) | Impurity(Y) | Y/X | Test 1 | Test 2 | Test 3 |
| Ex. B1 | Talc | Dolomite | 0.03 | 0/10 | ○ | ○ |
| Ex. B2 | Talc | Dolomite | 0.03 | 0/10 | ○ | ○ |
| Ex. B3 | Talc | Dolomite | 0.03 | 0/10 | ○ | ○ |
| Ex. B4 | Talc | Silica | 0.10 | 0/10 | ○ | ○ |
| Ex. B5 | Talc | Magnesite | 0.20 | 0/10 | Δ | ○ |
| Comp. Ex. B1 | Talc | Dolomite | 0.30 | 0/10 | X | ○ |
| Comp. Ex. B2 | Talc | Dolomite | 0.003 | 8/10 | ○ | X |
| Comp. Ex. B3 | Talc | Silica | 0.40 | 0/10 | X | ○ |

As described above, the optimization of the hardness by specifying the content of an impurity in an inorganic filler contained in a heat-resistant slip layer according to the present invention can provide a thermal transfer sheet having a good heat-resistant slip layer which has excellent slip property, releasability, carriability of a thermal head, avoids sticking, cockle, and damage, and is less likely to abrade the thermal head.

We claim:

1. A thermal transfer sheet comprising:

a substrate;

a heat-transferable colorant layer provided on one side of the substrate; and a heat-resistant slip layer, containing an inorganic filler, provided on the other side of the substrate, the inorganic filler comprising a main component and an impurity, the hardness of the main component and the hardness of the impurity having the relationship: main component<impurity, the ratio of the highest diffraction line intensity Y of the impurity to the highest diffraction line intensity X of the main component in the X-ray diffraction of the inorganic filler being $0.03 \leqq Y/X \leqq 0.20$.

2. The thermal transfer sheet according to claim 1, wherein the inorganic filler is in the form of a mixture of two or more inorganic fillers different from each other in X/Y value and the ratio of the highest diffraction line intensity Y of the impurity to the highest diffraction line intensity X of the main component in the X-ray diffraction of the mixture being $0.03 \leqq Y/X \leqq 0.20$.

3. The thermal transfer sheet according to claim 1, wherein the inorganic filler has an average particle diameter of 0.5 to 10 $\mu$m.

4. The thermal transfer sheet according to claim 1, wherein the inorganic filler is talc.

5. The thermal transfer sheet according to claim 1, wherein the impurity contained in the inorganic filler is a substance selected from the group consisting of dolomite, magnesite, and crystalline silica.

* * * * *